US009133529B2

(12) United States Patent
Thillen et al.

(10) Patent No.: US 9,133,529 B2
(45) Date of Patent: Sep. 15, 2015

(54) DEVICE FOR DISTRIBUTING BULK MATERIAL WITH A DISTRIBUTION SPOUT SUPPORTED BY A CARDAN SUSPENSION

(75) Inventors: Guy Thillen, Diekirch (LU); Emile Lonardi, Bascharage (LU); Jean-Joseph Stumper, Luxembourg (LU); Harald Lang, Trier (DE); Klaus Mutschler, Saarburg (DE)

(73) Assignee: PAUL WURTH S.A., Luxembourg (LU)

( * ) Notice: Subject to any disclaimer, the term of this patent is extended or adjusted under 35 U.S.C. 154(b) by 502 days.

(21) Appl. No.: 13/642,585

(22) PCT Filed: Apr. 14, 2011

(86) PCT No.: PCT/EP2011/055879

§ 371 (c)(1),
(2), (4) Date: Oct. 22, 2012

(87) PCT Pub. No.: WO2011/131548

PCT Pub. Date: Oct. 27, 2011

(65) Prior Publication Data

US 2013/0039723 A1 Feb. 14, 2013

(30) Foreign Application Priority Data

Apr. 22, 2010 (LU) ..... 91683

(51) Int. Cl.

| | |
|---|---|
| ***C21B 7/20*** | (2006.01) |
| ***F27B 1/20*** | (2006.01) |
| ***F27D 3/10*** | (2006.01) |

(52) U.S. Cl.

CPC ... *C21B 7/20* (2013.01); *F27B 1/20* (2013.01); *F27D 3/10* (2013.01)

(58) Field of Classification Search

CPC ..... C21B 7/20

See application file for complete search history.

(56) References Cited

U.S. PATENT DOCUMENTS

| | | | |
|---|---|---|---|
| 3,693,812 | A | 9/1972 | Mahr et al. |
| 3,814,403 | A | 6/1974 | Legille |

(Continued)

FOREIGN PATENT DOCUMENTS

| | | | |
|---|---|---|---|
| DE | 2649248 | A1 | 5/1978 |
| EP | 0065084 | A1 | 11/1982 |

(Continued)

OTHER PUBLICATIONS

International Search Report; International Application No. PCT/EP2011/055879; International Filing Date Apr. 14, 2011; Mail Date May 31, 2011.

Written Opinion; International Application No. PCT/EP2011/055879; International Filing Date Apr. 14, 2011; Mail Date May 31, 2011.

*Primary Examiner* — Jonathan Snelting

(74) *Attorney, Agent, or Firm* — Cantor Colburn LLP

(57) ABSTRACT

A distribution device for distributing bulk material with a distribution spout on a cardan suspension that has a first and a second gimbal member pivotable about two perpendicular suspension axes where a drive arrangement has a first and a second transmission mechanism for controlling pivotal motion of the distribution spout about the suspension axes, and the drive arrangement has a further cardan joint, with a first part pivotable about a third axis and a second part pivotable about a fourth axis, and a rotary motor for driving a rotary drive shaft that is connected to the cardan joint by means of an articulated connecting arm such that the rotational position and the axial position of the drive shaft determine the pivotal position of the second part about the third and fourth axes respectively, where the transmission mechanisms transmit torque about the third and fourth axes from the cardan joint to the cardan suspension for pivoting the distribution spout about the first and second axes respectively.

18 Claims, 5 Drawing Sheets

(56) References Cited

U.S. PATENT DOCUMENTS

| | | | | |
|---|---|---|---|---|
| 3,972,426 | A * | 8/1976 | Tachiyama | 414/194 |
| 4,243,351 | A | 1/1981 | Legille et al. | |
| 4,306,827 | A | 12/1981 | Tsutsumi et al. | |
| 4,525,120 | A | 6/1985 | Legille et al. | |
| 4,889,004 | A | 12/1989 | Mailliet et al. | |
| 4,889,008 | A | 12/1989 | Legille et al. | |
| 4,941,792 | A | 7/1990 | Cimenti et al. | |
| 5,022,806 | A | 6/1991 | Lonardi et al. | |

FOREIGN PATENT DOCUMENTS

| | | | |
|---|---|---|---|
| EP | 1833999 | A1 * | 9/2007 |
| GB | 2063435 | A | 6/1981 |
| IT | 1103916 | | 10/1985 |
| IT | 1126248 | | 3/1986 |
| JP | 58207303 | A | 12/1983 |
| WO | 9521272 | A1 | 8/1995 |
| WO | 2006056350 | A1 | 6/2006 |

* cited by examiner

DEVICE FOR DISTRIBUTING BULK MATERIAL WITH A DISTRIBUTION SPOUT SUPPORTED BY A CARDAN SUSPENSION

TECHNICAL FIELD

The present invention generally relates to charging of material into a metallurgical reactor, e.g. a melter-gasifier, an aggregate reactor or a blast furnace. More specifically, the invention relates to a device for distributing charge material within the metallurgical reactor.

BACKGROUND ART

The distribution device is a key component of any typical top charging installation because proper charge distribution is crucial for reactor operation.

In the iron-making industry, a charging system commercially known by the name bell less Top® has found widespread use for charging blast furnaces. This system typically includes a distribution device with a distribution chute that is rotatable about the vertical furnace axis and pivotable about a horizontal axis for distributing bulk material on the stockline as desired. The device has a mechanism for rotating and pivoting the distribution chute according to the desired charging profile. Systems of this type have been disclosed for example in international patent application WO 95/21272 and in U.S. Pat. No. 5,022,806; U.S. Pat. No. 4,941,792; U.S. Pat. No. 3,814,403 and U.S. Pat. No. 3,693,812. By rotating the chute about the vertical furnace axis and by varying the inclination of the chute, burden in bulk can be directed to virtually any point of the charging surface. Besides many other advantages, this type of distribution device enables a wide variety of charging profiles due to its versatility in distributing the burden on the charging surface. Accordingly, it requires highly developed equipment, in particular as regards the mechanism for rotating and pivoting distribution chute.

A currently less widespread alternative is a so-called cardan-type or gimbal-type distribution device. This type has a tubular distribution spout that is suspended in cardanic manner so as to be pivotable about two generally perpendicular axes of which one is typically horizontal. Since cardan-type devices have no revolving spout support that rotates full turns (>360°), they theoretically facilitate construction of the drive equipment and, if cooling of the chute is desired, of corresponding cooling equipment.

An early example of a cardan-type distribution device is disclosed in U.S. Pat. No. 4,243,351. The spout is suspended on a supporting fork, which is rotatably supported on its first end to provide for pivoting about a first horizontal axis. The spout is pivotally suspended on the pronged second end of the support fork to provide for pivoting the spout about a second axis perpendicular to the first axis. A first actuator is connected to the first end of the support fork for pivoting about the first axis. The support fork further carries a transmission mechanism for transmitting action of a second actuator from the first end of the supporting fork to the pivoting suspension of the spout on its second end. A variety of similar designs have been proposed in patent literature, e.g. in: U.S. Pat. No. 3,972,426; U.S. Pat. No. 4,306,827; U.S. Pat. No. 4,525,120; IT 1103916; IT 1126248 and DE 2 649 248. Examples of suitable drive arrangements for pivoting the spout are described in more detail e.g. in U.S. Pat. No. 4,306,827 and U.S. Pat. No. 4,889,004 and U.S. Pat. No. 4,889,008. In such devices, the support of the spout is a generally fork-shaped member as described above that carries both the spout and a transmission mechanism connected to the second actuator for pivoting about the second axis. The fork-type support being designed for significant loads and torques, it has comparatively large size and heavy weight thus increasing the moment of inertia on the first axis, i.e. the main suspension axis.

Designs with reduced moment of inertia on the main suspension axis have been proposed in Japanese patent application JP 58 207303 and in European Patent EP 1 833 999. In these devices, a conventional cardan construction with two ring-shaped gimbal members supports the spout. A drive arrangement with two similar transmission mechanisms connects the cardan suspension, in particular the gimbal member that has both pivotal degrees of freedom, to respective actuators. Compared to the aforementioned fork-type designs, the gimbal members are compact and less heavy since they do not carry the load of any transmission mechanism. A drawback of designs according to JP 58 207303 and EP 1 833 999 resides in the actuators used in their drive arrangement. As opposed to drive configurations according to U.S. Pat. No. 4,306,827 and U.S. Pat. No. 4,889,004 and U.S. Pat. No. 4,889,008, they use linear actuators i.e. hydraulic cylinders for actuation of each of the two degrees of freedom. As will be understood, such design implies that each actuator is permanently oscillating for achieving typical charging patterns that require circular or spiral motion of the spout outlet. As a result, a device according to JP 58 207303 and EP 1 833 999 is inherently subject to a certain degree of actuator outage and consequent repair.

BRIEF SUMMARY

In view of the foregoing, the present disclosure provides a distribution device that has a cardan-type spout suspension with comparatively low moment of inertia and a more reliable drive arrangement.

The invention concerns any device for distributing bulk material in a metallurgical reactor, in particular in a blast furnace, that comprises a distribution spout supported by a cardan suspension.

The cardan suspension typically has a first gimbal member pivotable about a first axis and a second gimbal member pivotable about a second axis, the second axis being preferably perpendicular to the first axis. The second gimbal member is pivotally supported by the first gimbal member. Furthermore, the device has a drive arrangement with two transmission mechanisms, e.g. linkage mechanisms, for controlling pivotal motion of the distribution spout about the first and second cardan axes.

The drive arrangement includes a supplementary or auxiliary cardan joint with a first part pivotable about a third axis and a second part pivotable about a fourth axis, the fourth axis being also preferably perpendicular to the third axis. The second part is pivotally supported by the first part. The drive arrangement further has a rotary motor coupled to or equipped with a rotary drive shaft that is arranged to be axially slideable in any suitable manner. The drive shaft is connected to the second part of the cardan joint by means of an articulated connecting arm so that the rotational position and the axial position of the drive shaft determine the pivotal position of the second part about the third and fourth axes respectively. The two transmission mechanisms connect the supplementary cardan joint to the cardanic spout suspension so that torque (moment) about the third and fourth axes respectively is transmitted from the auxiliary joint to the suspension for pivoting the distribution spout, about the first and second cardan axes respectively, as required. More specifically, the first transmission mechanism connects one of the first part to the first gimbal member or the second part to the second gimbal member. On the other hand, the second transmission mechanism connects the second part to the second gimbal member.

By providing a supplementary cardan joint that—when thought disconnected from the transmission mechanisms—is independent of the cardan suspension of the spout, the proposed configuration enables a drive system with a rotary motor as a main drive/actuator for actuating a cardan type suspension i.e. operating the spout during typical concentric ring charging. The auxiliary cardan joint provides two additional degrees of freedom independent of those of the cardanic spout suspension and—by virtue of the transmission mechanisms—may be located at any suitable location, e.g. laterally offset from the reactor axis. Accordingly, the third and fourth axes of the auxiliary cardan joint are offset from the first and second axis respectively, even though they may be respectively parallel. Consequently, components of the drive arrangement, especially the actuators, may be suitably located partly inside the reactor enclosure or, preferably, outside the reactor enclosure to reduce exposure to the reactor atmosphere.

As will be understood, the use of a rotary motor as an actuator allows charging typical ring-shaped or spiral patterns without the need for a constantly reciprocating motion of linear actuators. Accordingly, due to the typically high availability of rotary drives i.e. due to their inherent reliability, the proposed construction is less subject to actuator outage and therefore more reliable than prior art devices as proposed in JP 58 207303 or EP 1 833 999.

BRIEF DESCRIPTION OF THE DRAWINGS

Preferred embodiments of the invention will now be described, by way of non-limiting illustration, with reference to the accompanying drawings in which.

Throughout these drawing identical reference signs or reference signs with incremented hundreds digit identify identical or similar parts.

DETAILED DESCRIPTION

Figure 1B:
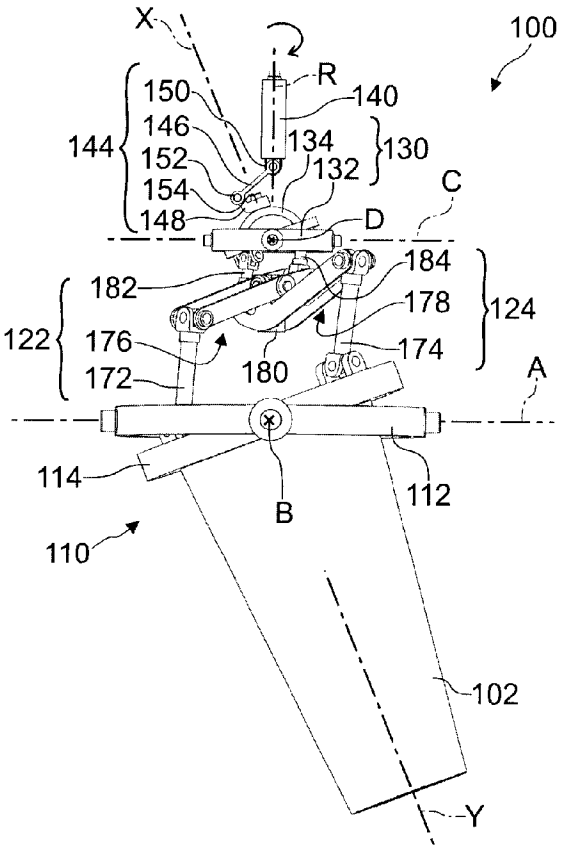
FIGS. 1A&1B are side views of a first embodiment of a charging device having a distribution spout supported by means of a cardan suspension, FIG. 1A and FIG. 1B being views along either of the two perpendicular cardan suspension axes respectively.
Figure 1A:
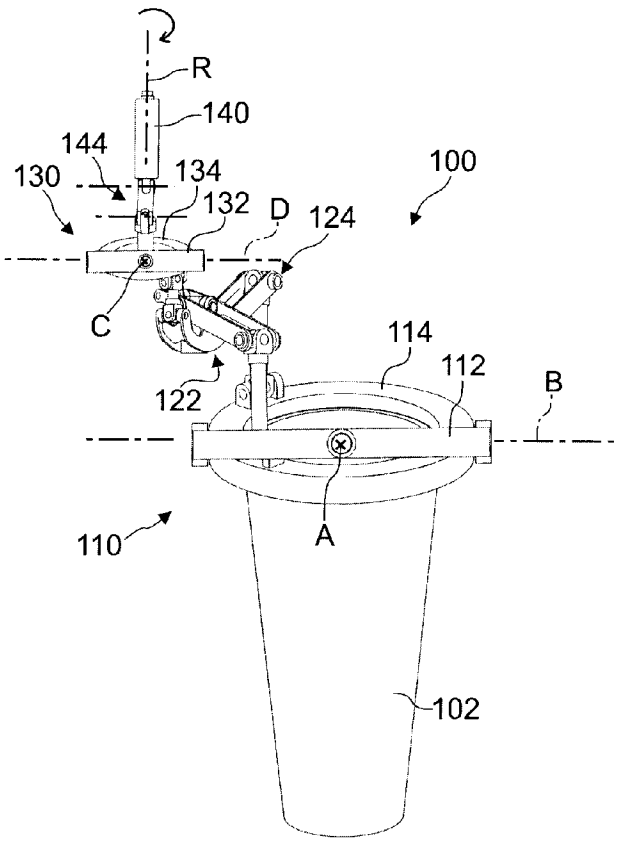

FIGS. 1A&1B illustrate a first embodiment of a distribution device, generally identified by reference numeral 100. The device 100 includes a distribution spout 102 of tubular shape, e.g. with a chute body having a frustoconical envelope. The distribution spout 102 is supported by means of a cardan suspension 110 that includes an outer first gimbal member 112 and an inner second gimbal member 114. In the illustrated embodiment, both gimbal members 112, 114 are annular gimbal rings. By virtue of the cardan suspension 110, the outlet of the spout 102 can be oriented as desired in any direction to direct the flow of bulk charge material to any desired point of a charging surface inside the reactor.

Figure 2:
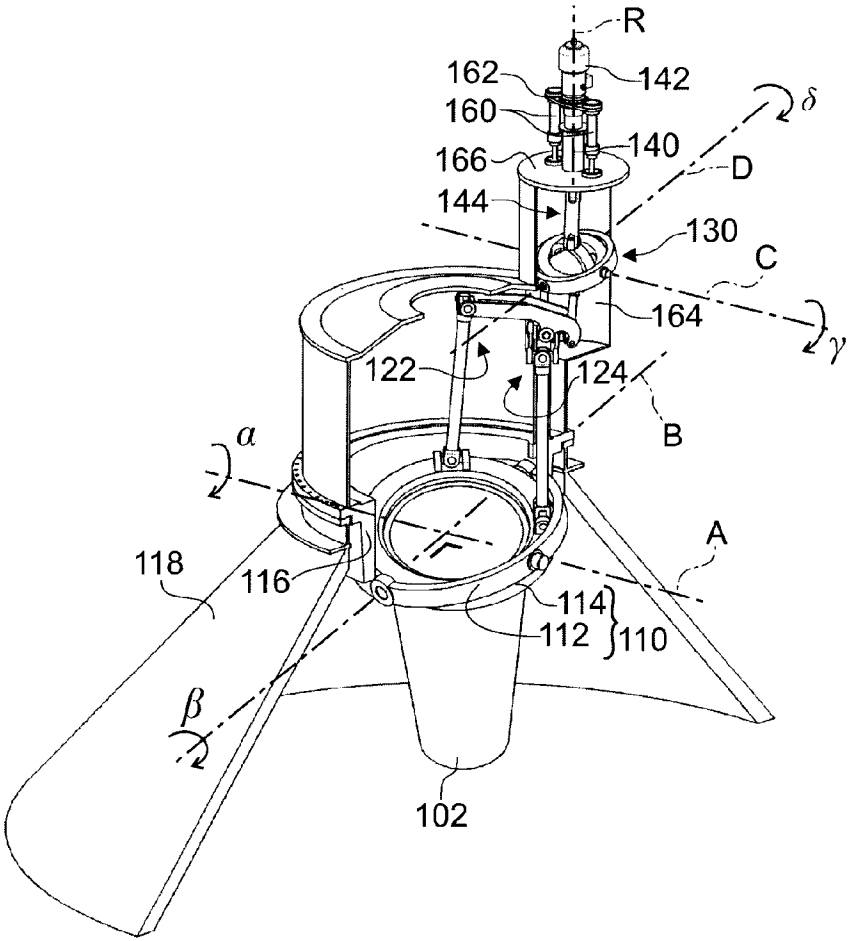
FIG. 2 is a perspective view of a charging device configured according to FIG. 1 and installed in the top part of a metallurgical reactor.

As best seen in FIG. 2, the outer gimbal member 112 has diagonally opposite pivots by means of which it is pivotally supported on an annular supporting structure 116 that is fixed inside a top part 118 of the metallurgical reactor (not shown in full), e.g. of a blast furnace throat. Accordingly, the first gimbal member 112 is pivotal about a generally horizontal first axis A. The second gimbal member 114 of smaller diameter is supported on diagonally opposite pivots that connect the second gimbal member 114 to the first gimbal member 112 so that the second gimbal member 114 is pivotal about a second axis B that lies in a plane perpendicular to axis A. The distribution spout 102 is removably mounted to the gimbal suspension 110, e.g. with its upper end inside the inner second gimbal member 114. As will be understood, an inverted arrangement, with an inner gimbal member supported on the reactor structure, e.g. on a feeder spout (not shown) and with a spout-supporting outer gimbal member pivotally supported on the inner gimbal member is also within the scope of the invention. The gimbal suspension 110 is typically arranged so that, in vertical position, the distribution spout 102 is coaxial to the reactor main axis.

In order to actuate the spout 102, e.g. so that its outlet describes a circular or spiral path, the distribution device 100 comprises a drive arrangement. As best seen in FIGS. 1A&1B, the drive arrangement has a first transmission mechanism 122 and a second transmission mechanism 124, both connected on their output side to the cardan suspension 110 for transmitting torque to the gimbal members 112, 114 respectively. The transmission mechanisms 122, 124 serve to pivot the spout 102 about axis A and/or axis B as required. To this effect, the input side of the transmission mechanisms 122, 124 is connected to an auxiliary cardan joint 130 that comprises an outer first part 132 that is supported on diagonally opposite pivots to pivot about a generally horizontal third axis C (see FIG. 1B) and an inner second part 134, that is supported by the first part 132 on diagonally opposite pivots to pivot about a fourth axis D (see FIG. 1A) that is perpendicular to axis C. Accordingly, alike the spout 102, the second part 134 is supported in gimballed or cardanic manner. Whereas FIGS. 1A&1B illustrate an embodiment in which the axes and the axes are respectively parallel, other configurations are possible (see FIGS. 4A&B) provided the angle between axes A and B is identical to the angle between axes C and D. As will also be noted, the latter angle need not be 90°. However, as illustrated, the respective cardan axes and preferably cross-each other perpendicularly.

Whereas the illustrated first part 132 of the cardan joint 130 is made of a simple annular gimbal ring, the second part 134 has a ring-shaped part, which is connected by pivots to the first part 132, and a bow shaped or C-shaped part fixed perpendicularly to its ring-shaped part.

As further seen in FIGS. 1A&1B, the drive arrangement includes a rotary drive shaft 140 that is driven in rotation about is longitudinal axis R. FIG. 2 illustrates an electric rotary motor 142 (not shown in FIGS. 1A&2A) which includes and drives the rotary drive shaft 140. Alternatively, the drive shaft could be mounted independently and driven by a motor with a separate drive shaft e.g. through a reduction gear.

As best seen in FIG. 1B, the rotary drive shaft 140 is connected to the second part 134 of the cardan joint 130 by means of an articulated connecting arm 144 (FIG. 1A). The connecting arm 144 includes a first member 146 and a second member 148. The first member 144 has an upper end articulated to the lower end of the rotary drive shaft 140 by means of a first rotary joint 150 with an axis perpendicular to axis R (and the plane of FIG. 1B). The second member 146 is articulated to the lower end of the first member 144 by means of a second rotary joint 152 with an axis parallel to that of the first rotary joint 150. As will be appreciated, the second member 148 is further articulated to the second part 134 of the cardan joint 130 by means of a third rotary joint 154 the axis of which is perpendicular to axis D and coincides with the central axis X of the ring-shaped portion of the second part 134. The third rotary joint 154 can be formed e.g. with a pivot arranged on the C-shaped portion of the second part 134. As will be noted, the second member 146 of the connecting arm 140 is configured so that the axis of the second rotary joint 152 is laterally offset i.e. eccentric with respect to axis X. Accordingly, whereas the axes of the first and third rotary joints 150, 154 can coincide, the axis of all three rotary joints 150, 152, 154 in the connecting arm 144 cannot be aligned, irrespectively of the axial position of the rotary driving shaft 140. Thereby, the connecting arm 140 is configured to avoid mechanical deadlock (when axis X is positioned vertically).

In order to vary the angle of the central axis X of the second part 134 with respect to the vertical, the rotary drive shaft 140 is axially slideable along axis R. To this effect, as best seen in FIG. 2, the drive arrangement comprises a pair of hydraulic actuators 160 that slideably support a mounting flange 162 with respect to a housing 164 inside which the cardan joint 130 is arranged. The hydraulic actuators 160 are supported on a support plate 166 of the housing 164. The rotary drive shaft 140 together with the motor 142 are supported by the slideable mounting flange 162 so that the axial position of the rotary drive shaft 140 and thereby the degree of extension of the articulated connecting arm 144 is controlled by means of the hydraulic actuators 160. Accordingly, when the drive shaft 140 is lifted upwards or downwards, the second part 134 tilts so that the angle between its axis X and the vertical becomes smaller or larger respectively. In order to avoid escape of gas in case of a pressurized reactor, the rotary drive shaft 140 passes through a suitable gas-tight seal or gasket (not shown) arranged in an opening in the support plate 166.

As follows from the foregoing, the pivotal orientation of the second part 134 in the cardan joint 130 about axes C and D is determined by the rotational and axial position of the drive shaft 140. The axis X can be oriented as desired using the rotary motor 142 and the hydraulic actuators 160. Rotation of the drive shaft 140 moves the second part 134 so that its main axis X describes a cone, the cone angle of which depends on the axial position of the drive shaft 140.

The transmission mechanisms 122, 124 connect the cardan suspension 110 to the cardan joint 130 so that the pivotal angles $\alpha$, $\beta$ of the second gimbal member 114, and therewith of the spout 102, about axes A, B are respectively determined by the pivotal angles $\gamma$, $\delta$ of the second part 134 about axis C, D respectively (see FIG. 2). In other words, the transmission mechanisms 122, 124 transmit torque exerted by the motor 142 and the actuators 160 on the gimbal joint 130 through the rotary shaft 140 from the gimbal joint 130 onto the gimbal suspension 110 to pivot the spout 102 as desired.

In the preferred embodiment of FIGS. 1A, 1B and FIG. 2, each transmission mechanism 122, 124 is a linkage mechanism that comprises a respective output connecting rod 172, 174 having a lower end articulated with the cardan suspension 110 by means of a universal joint. As illustrated, both output connecting rods 172, 174 are preferably articulated with the second gimbal member 114, e.g. symmetrically at 45° to either side of axis B. Each transmission mechanism further has a respective pivoted lever 176, 178 mounted on pivots of a supporting block 180. As seen in FIGS. 1A&1B, the levers 176, 178 have a short lever arm and a long lever arm. Each output connecting rod 172, 174 is articulated at its upper end with a universal joint to the longer lever arm of the respective lever 176, 178. Each transmission mechanism 122, 124 further has a respective input rod 182, 184 that connects the shorter lever arm to the cardan joint 130. As illustrated, the input rods 182, 184 are preferably both articulated to the second part 134, e.g. symmetrically at 45° to either side of axis D. The input rods 182, 184 are also connected at each side by means of universal joints. As further seen in FIGS. 1A&1B, the levers 176, 178 have a hollow conjugated construction and are arranged so that their pivoting axes are perpendicular and crossing in the upper end of the supporting block 180. Despite a differing shape, the levers 176, 178 have identical leverage, more specifically a leverage ratio <1 ("mechanical disadvantage") in the output direction. The longer arm on the output side allows reducing the size of the cardan joint 130 that "imitates", in the manner of a replica, the cardan suspension 110, so that the transmission linkages 122, 124 form a kind of "pantograph" between them. More specifically, the transmission mechanisms 122, 124 are configured with identical transmission ratio and so that they warrant a homothetic transmission from the cardan joint 130 to the cardan suspension 110. The aforementioned point where the pivoting axes of levers 176, 178 cross thus represents the homothetic center (also called center of similarity) of the motion transformation from the auxiliary cardan joint 130 to the actual cardan suspension 110. It follows that the angle $\alpha$ is kept equal to the angle $\gamma$ and also that the angle $\beta$ is kept equal to the angle $\delta$. In the first embodiment, the orientation of the central axis Y of the spout 102 is therefore kept parallel to the main axis X of the second part 134 of the cardan joint 130 as best seen in FIG. 1B.

Figure 3B:
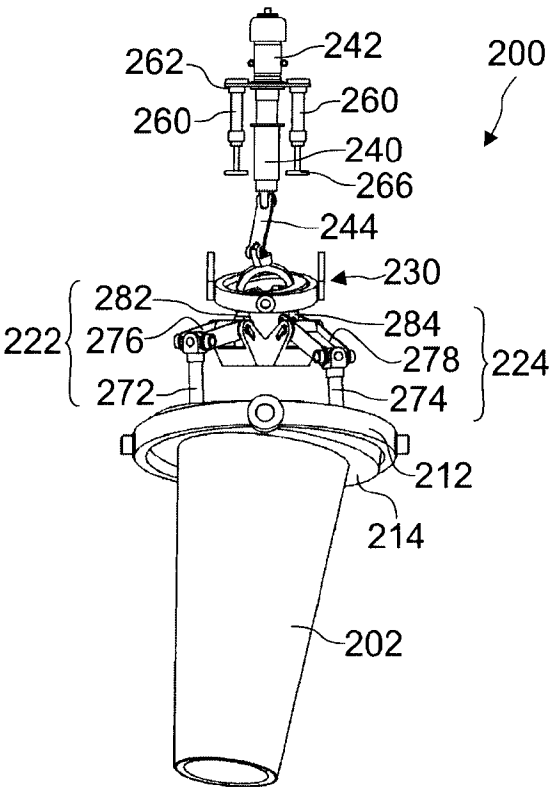
FIGS. 3A&3B are side views of a second embodiment of a charging device (FIG. 3A and FIG. 3B being views along either of the two perpendicular cardan suspension axes respectively)
Figure 3A:
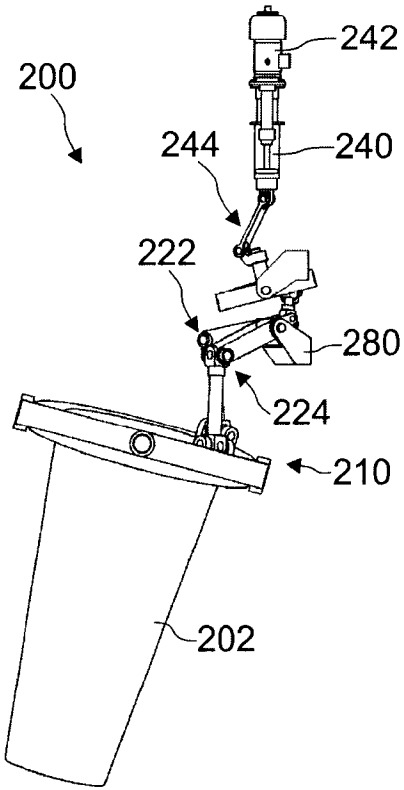

FIGS. 3A&3B illustrate an alternative distribution device 200, in which most components are identical to those of FIGS. 1A&1B. The main difference resides in an alternative configuration of the transmission mechanisms 222, 224 that connect the cardan suspension 210 to the supplementary cardan joint 230. The linkage mechanisms 222, 224 both have symmetrical and identical configuration. As will be noted, they have identical lever arms 276, 278 which are arranged side-by-side as opposed to the arrangement in FIGS. 1A&1B. The pivoting axes of the lever arms 276, 278 are also intersecting but not perpendicular. Whereas the configuration of FIGS. 3A&3B is possibly less compact, it is more economical in construction and maintenance. Other features of structure and function are identical to those of FIGS. 1A&1B (and identified by corresponding reference numerals with a two-hundreds digit).

Figure 4B:
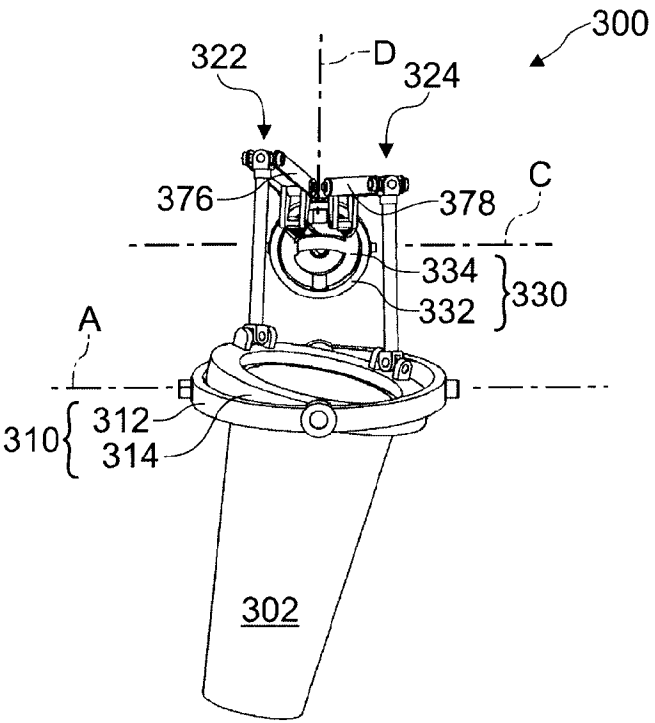
FIGS. 4A&4B are side views of a third embodiment of a charging device (FIG. 4A and FIG. 4B being views along either of the two perpendicular cardan suspension axes respectively)
Figure 4A:
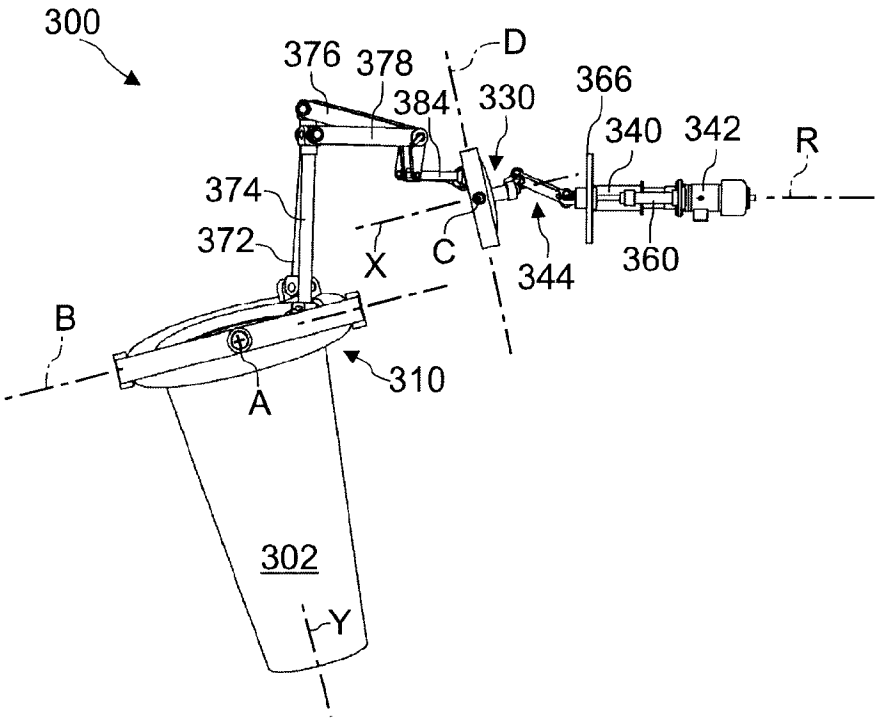

FIGS. 4A&4B illustrate a third embodiment of a distribution device 300 in accordance with the invention. In the distribution device 300, as opposed to the previous embodiments, the rotary drive shaft 340 has a horizontal axis R. Therefore, the cardan joint 330 that replicates the cardan suspension 310 is generally rotated by 90°. In other words, the pivotal axis D of the second part 334 forms a right angle with respect to the corresponding pivotal axis B of the second gimbal member 314. Thus, when the chute 302 is oriented vertically, the pivotal axis D is vertical (as opposed to horizontal in FIGS. 1A&1B) and the main axis X of the second part 334 is horizontal (as opposed to vertical in FIGS. 1A&1B) to be aligned with the axis R of the rotary drive shaft 340. Consequently, the transmission mechanisms 322, 324 of the device 300 have yet another configuration. Whilst they are symmetrical, their pivoted levers 376, 378 are elbowed, more specifically, they are arranged with their short lever arm being bent at a generally right angle with respect to their long lever arm. Other features of structure and function correspond to those described above. The configuration of FIGS. 4A&4B allows arranging the rotary motor 342 and the linear actuators 360 laterally of the reactor top, thereby enabling space savings at the level of the top inlet of the reactor (e.g. at the throat opening of a blast furnace).

Figure 5:
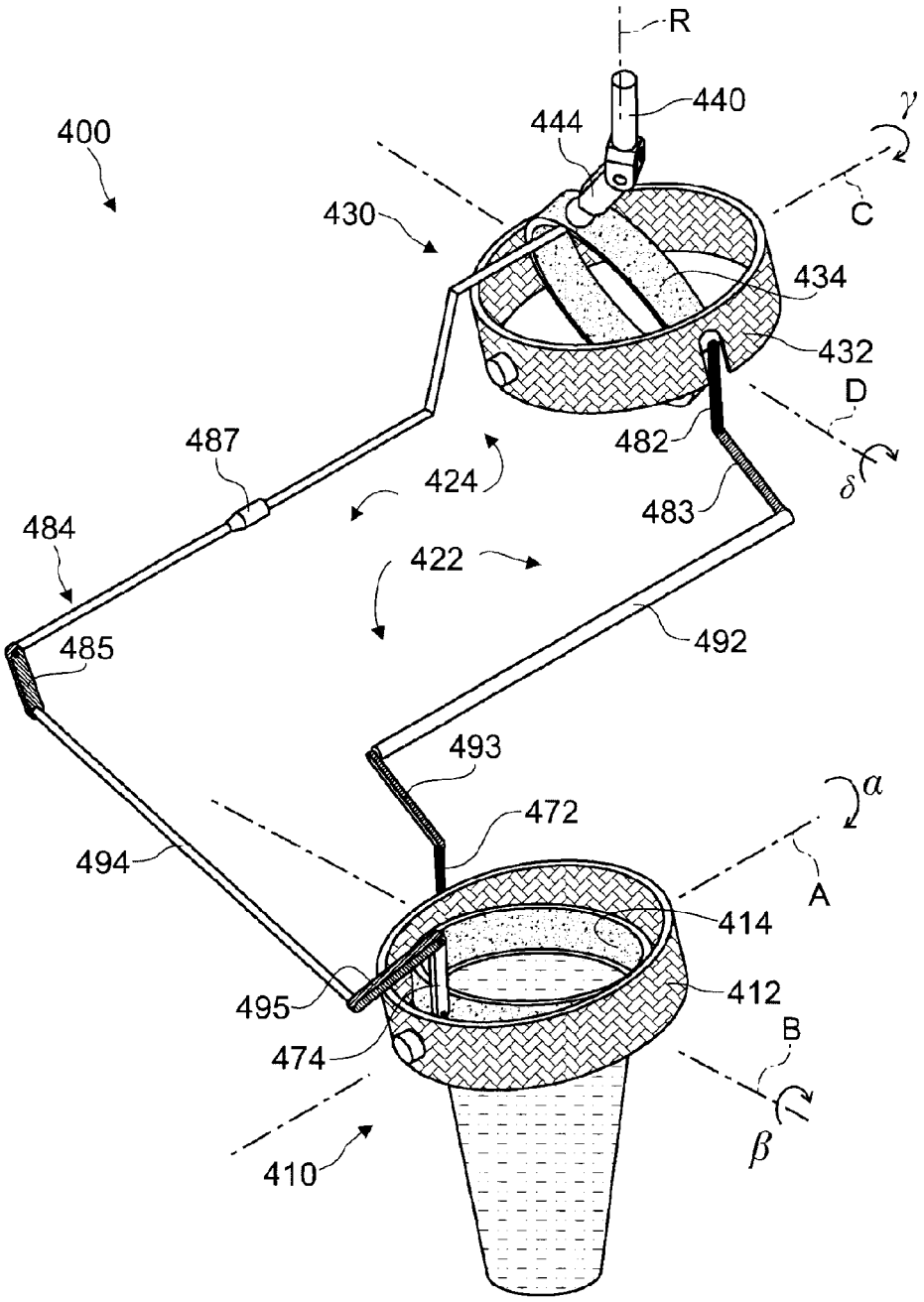
FIG. 5 is a perspective view schematically illustrating a fourth embodiment of a charging device.

FIG. 5 schematically illustrates an alternative fourth embodiment of a distribution device 400 with a cardan suspended spout and an auxiliary cardan joint 430 driven by an axially slideable rotary drive shaft 440. In the device 400, the transmission mechanisms 422, 424 that link the cardan joint 430 to the cardan suspension 410 of the spout (not shown in FIG. 5) have yet another different configuration compared to the previous embodiments.

The first transmission mechanism 422 connects the outer gimbal member 412 to the outer first part 432 of the cardan joint 430. To this effect, it has pivotal shaft 492 with an output crank arm 493 fixed at a right angle to the pivotal shaft 492. An output connecting rod 472 with universal joints connects the output crank arm 493 to the first gimbal member 412. In similar manner, the pivotal shaft 492 has an input crank arm 483 articulated to the first part 432 of the cardan joint 430 by means of an input connecting rod 482. For increasing the lever arm about axes A and C, the points of connection of the input and output rods 472, 482 to the first gimbal member 412 and to the first part 432 are located on pivotal axes B and D respectively. The pivotal shaft 492 is preferably arranged with its axis parallel to the pivotal axis A of the first gimbal member 412.

The second transmission mechanism 424 of FIG. 5 on the other hand connects the inner gimbal member 414 to the inner second part 434 of the cardan joint 430. It also has a pivotal shaft 494 with an output crank arm 495 perpendicular to the pivotal shaft 494. The output crank arm 495 is also linked to the second gimbal member 414 by an output connecting rod 474. An input crank arm 485 on the pivotal shaft 494 is connected to an input connecting linkage 484 of different configuration. The input connecting linkage 484 comprises a first link articulated to the second part 434 and a second link articulated to the input crank arm 485. A rotary joint 487 connects both links to each other so as to permit unrestricted pivoting of the second part 434 about axis C. The required rotational degree may alternatively be incorporated in a universal joint on the input crank arm 485. The points of connection of the output rod 474 and of the input linkage 484 to the first gimbal member 412 and to the first part 432 are located on pivotal axes A and C respectively. The pivotal shaft 494 is preferably arranged with its axis parallel to the pivotal axis B of the second gimbal member 414. The crank arms 483, 493; 485, 495 of each pivotal shaft 492, 494 may have identical or different lengths to achieve a desired transmission ratio (mechanical advantage/disadvantage). The device 400 of FIG. 5 allows locating the auxiliary cardan joint 430 and part of the transmission mechanisms 422, 424 outside of the reactor enclosure (see FIG. 2). As will be understood this is readily achieved by providing an enclosure or housing having suitable openings in the sidewalls through which each pivotal shaft 492, 494 penetrates using a suitable seal at the opening.

Other components of the device 400 (not shown) correspond to those described above in relation to the first, second and third embodiment. As will be noted, an embodiment according to FIG. 5 is particularly suitable as to perform a retrofit improvement of a device according to JP 58 207303 and EP 1 833 999.

In conclusion, it will be understood that any of the previously discussed embodiments enables distributing material in ring-shaped charging profiles by virtue of the rotary motor driving the drive shaft without any need for operation of the linear actuators during circling of the spout outlet. The linear actuators are required only to vary the radius of the charging profile. Alternatively, a spiral pattern can be charged with a single stroke of the linear actuator(s). Consequently, as opposed to the prior art devices of JP 58 207303 and EP 1 833 999 it will be appreciated that no continuous reciprocating motion of linear actuators is needed for achieving typical charging profiles.

The invention claimed is:

1. A device for distributing bulk material in a metallurgical reactor, said device comprising a distribution spout supported by a cardan suspension with a first gimbal member that is pivotable about a first axis and a second gimbal member that is pivotable about a second axis and supported by said first gimbal member;

a drive arrangement with a first transmission mechanism connected to said cardan suspension and a second transmission mechanism connected to said cardan suspension for controlling pivotal motion of said distribution spout about said first axis and about said second axis;

wherein said drive arrangement further comprises a cardan joint with a first part that is pivotable about a third axis and a second part that is pivotable about a fourth axis and supported by said first part; and a rotary motor for driving a rotary drive shaft that is axially slideable and connected to said second part of said cardan joint by means of an articulated connecting arm so that a rotational position and an axial position of said drive shaft determine a pivotal position of said second part about said third and fourth axes respectively;

wherein, said first transmission mechanism connecting said first part to said first gimbal member or said second part to said second gimbal member and said second transmission mechanism connecting said second part to said second gimbal member so that torque about said third and fourth axes respectively is transmitted from said cardan joint to said cardan suspension for pivoting said distribution spout about said first and second axes respectively.

2. The device for distributing bulk material according to claim 1, wherein said first transmission mechanism and said second transmission mechanism have identical transmission ratio and are configured for homothetic transmission from said cardan joint to said cardan suspension so that pivotal angles of said second part about said third and fourth axes are respectively equal to pivotal angles of said second gimbal member about said first and second axes.

3. The device for distributing bulk material according to claim 1, wherein said drive arrangement further comprises at least one linear actuator for varying the axial position of said drive shaft along its axis of rotation.

4. The device for distributing bulk material according to claim 1, wherein each transmission mechanism is a linkage mechanism that comprises an output rod articulated with one of said gimbal members.

5. The device for distributing bulk material according to claim 4, wherein each linkage mechanism comprises a pivotal shaft with an output crank arm, said output rod having a first end articulated with one of said gimbal members and a second end articulated with said output crank arm, each pivotal shaft being driven by said cardan joint.

6. The device for distributing bulk material according to claim 5, wherein said device comprises a housing, each transmission mechanism comprising a member that passes in sealed manner through a respective opening in said housing, so that said cardan joint is located outside said housing and so that said transmission mechanisms are at least partly located outside said housing.

7. The device for distributing bulk material according to claim 4, wherein each linkage mechanism comprises a pivoted lever, said output rod having a first end articulated with one of said gimbal members and a second end articulated with said pivoted lever.

8. The device for distributing bulk material according to claim 7, wherein each linkage mechanism further comprises an input rod having a first end articulated with said pivoted lever and a second end articulated with said second part of said cardan joint for driving said pivoted lever.

9. The device for distributing bulk material according to claim 8, wherein said pivoted levers have identical leverage and intersecting pivoting axes.

10. The device for distributing bulk material according to claim 9, wherein each pivoted lever has a short lever arm and a long lever arm, each output rod being connected to said long lever arm.

11. The device for distributing bulk material according to claim 8, wherein each pivoted lever has a short lever arm and a long lever arm, each output rod being connected to said long lever arm.

12. The device for distributing bulk material according to claim 7, wherein each pivoted lever has a short lever arm and a long lever arm, each output rod being connected to said long lever arm.

13. The device for distributing bulk material according to claim 1, wherein said first gimbal member is supported on pivots fixed to said metallurgical reactor so as to define said first axis, said second gimbal member is supported inside said first gimbal member on pivots defining said second axis perpendicular to said first axis and said distribution spout is removably mounted to said second gimbal member.

14. The device for distributing bulk material according to claim 1, wherein said first gimbal member is supported on pivots fixed to a feeder tube so as to define said first axis, said second gimbal member is supported outside said first gimbal member on pivots defining said second axis perpendicular to said first axis and said distribution spout is removably mounted to said second gimbal member.

15. The device for distributing bulk material according to claim 1, wherein said articulated connecting arm comprises a first member connected by means of a first rotary joint to said rotary drive shaft and a second member connected by means of a second rotary joint to said first member, said first and second rotary joints having parallel axes perpendicular to a rotation axis of said drive shaft, said second member being connected to said second part of said cardan joint by means of a third rotary joint arranged with its axis perpendicular to said fourth axis.

16. The device for distributing bulk material according to claim 15, wherein said second member is configured so that an axis of said second rotary joint is offset from the axis of said third rotary joint.

17. The device for distributing bulk material according to claim 1, further comprising a housing enclosing said cardan joint and said transmission mechanisms, said housing having an opening equipped with a seal through which said rotary drive shaft passes in sealed manner.

18. The device for distributing bulk material according to claim 17, wherein said housing has a support plate, said opening through which said rotary drive shaft passes being provided in said support plate, said drive arrangement comprising at least one hydraulic cylinder supporting said rotary motor and therewith said rotary drive shaft in slideable manner with respect to said support plate.

* * * * *